US006907633B2

(12) United States Patent
Paolini et al.

(10) Patent No.: US 6,907,633 B2
(45) Date of Patent: Jun. 21, 2005

(54) ZONING OF INFLATABLE BLADDERS

(75) Inventors: Raymond P. Paolini, Orchard Park, NY (US); Roland E. Flick, Elma, NY (US)

(73) Assignee: Gaymar Industries, Inc., Orchard Park, NY (US)

( * ) Notice: Subject to any disclaimer, the term of this patent is extended or adjusted under 35 U.S.C. 154(b) by 20 days.

(21) Appl. No.: 10/435,818

(22) Filed: May 12, 2003

(65) Prior Publication Data

US 2003/0213067 A1 Nov. 20, 2003

Related U.S. Application Data

(60) Provisional application No. 60/381,187, filed on May 16, 2002.

(51) Int. Cl.[7] ..... A47C 27/10
(52) U.S. Cl. ..... 5/713; 5/710; 5/935
(58) Field of Search ..... 5/706, 710, 713, 5/654, 655.3, 935

(56) References Cited

U.S. PATENT DOCUMENTS

| | | | | |
|---|---|---|---|---|
| 3,705,429 A | | 12/1972 | Nail | |
| 4,882,800 A | | 11/1989 | Schueler | |
| 5,412,822 A | | 5/1995 | Kelly | |
| 5,901,393 A | | 5/1999 | Pepe et al. | |
| 6,079,070 A | | 6/2000 | Flick | |
| 6,253,401 B1 | * | 7/2001 | Boyd | 5/713 |

FOREIGN PATENT DOCUMENTS

| | | |
|---|---|---|
| FR | 2707874 | 1/1995 |
| WO | WO 93/24088 | 12/1993 |
| WO | WO 02/065878 A2 | 8/2002 |

OTHER PUBLICATIONS

European search report for European patent application that corresponds to above application—2 pages—prepared Sep. 30, 2003.

* cited by examiner

*Primary Examiner*—Heather Shackelford
*Assistant Examiner*—Frederick Conley
(74) *Attorney, Agent, or Firm*—Roach Brown McCarthy & Gruber, PC; Kevin D. McCarthy

(57) ABSTRACT

The present invention is directed to diminish the material's creep problem found in inflatable bladders. This is accomplished by positioning an anti-creep zone within a bladder. The anti-creep zone is separated from the remainder of the bladder by a fluid barrier. The fluid barrier can have various embodiments that prevent and/or allow predetermined amounts of fluid into the anti-creep zone.

11 Claims, 4 Drawing Sheets

ZONING OF INFLATABLE BLADDERS

CLAIM OF PRIORITY

This application claims priority to U.S. provisional patent application Ser. No. 60/381,187, filed on May 16, 2002.

FIELD OF THE INVENTION

The present invention relates generally to inflatable cushions, mattresses and pads. In some embodiments, the invention can have alternately inflatable or expandable cells or bladders actuated by a pressure system.

BACKGROUND OF THE INVENTION

The present invention can be used with various types of bladders (or cells) used in inflatable cushions, mattresses or pads. In many cases these cushions, mattresses and pads are therapeutic and used by hospitals, businesses, and residences.

There are various types of cushions, mattresses or pads (collectively referred to as mattresses). Some of these variations are disclosed in commonly assigned U.S. Pat. No. 5,901,393 (Pepe et al.; title: Alternating Pressure Support Pad), and U.S. Pat. No. 6,079,070 (Flick; title: Disposable Inflatable Inclinable Cushion), which are hereby incorporated by reference. Obviously, these patents fail to disclose every type of inflatable mattresses but it does provide a representative sample.

In synopsis, every inflatable mattress has at least one bladder. That bladder can be made of polymeric materials having a top surface capable of receiving an object, a bottom surface that is opposite the top surface, and at least one side positioned between the top and bottom surfaces. In addition, every inflatable bladder is capable of receiving through an inlet a fluid, normally air or an aqueous solution, from a fluid source, normally a pump. From this fundamental understanding of inflatable bladders, the variations of bladders become evident. For example, some bladders (1) have the inlet of the fluid removed to become a self-contained device and (2) retain an inlet to receive fluid to become a dynamic device.

In the latter embodiment, the fluid exits the bladder through at least one outlet. In one version, the fluid exits the outlet through a conduit to return to the fluid source. In other versions the fluid exits the outlet through a conduit to a receiving unit, distinct from the fluid source. Another version has the surface of the bladder having a plurality of apertures designed to release at least a portion of the fluid toward the object lying on the inflatable bladder. Some bladders may have a CPR dump system to release the fluid expeditiously from the bladder.

Obviously, there may be alternative embodiments to these generic descriptions of bladders. In addition, the bladders may have alterations to (1) generate desired fluid flow patterns, (2) obtain desired mattress firmness and (3) allow the bladder adaptability for the mattress system. To obtain such results and others like it, the bladders have predetermined button welds, welds, and slits along welds. In addition, many of these alternative embodiments are embodied in numerous patent applications and patents, and product configurations.

As previously stated, numerous, if not all, inflatable bladders are constructed of some type of film material. The film material can be, for example, vinyl, polyethylene, or combinations thereof. When such film materials are used, the applicants have determined that the ability of the bladder to support loads for extended periods of time is greatly affected by creep of the material.

Creep occurs when an object, like a human, is placed on the mattress and displaces the air, at least immediately below the object, to the extremities of the bladder. Over time, creeping of the mattresses allows the object to bottom out on the inflatable mattress. Such results are undesirable and need to be minimized.

SUMMARY OF THE INVENTION

The present invention is directed to diminish the material's creep problem found in inflatable bladders. This is accomplished by positioning an anti-creep zone within a bladder. The anti-creep zone is separated from the remainder of the bladder by a fluid barrier. The fluid barrier can have various embodiments that prevent and/or allow predetermined amounts of fluid into the anti-creep zone.

DETAILED DESCRIPTION OF THE PRESENT INVENTION

The present invention is directed to a modification of bladders used in inflatable mattresses. Applicants admit that the bladder described in the Background of the Present Invention is a generic description of many bladders. This application, however, is not directed to bladders per se, but to what is within the bladders. Excluding fluids, welds, button welds and the like, the interior of a bladder is empty. It is empty because it is designed to have a fluid contained therein. Such designs, as described, above can result in creeping which in turn can result in bottoming out of the object on the mattress. Bottoming out and thus creeping are undesired. Therefore, applicants have modified the bladder design to diminish the possibility of such creeping and bottoming out.

Figure 1:
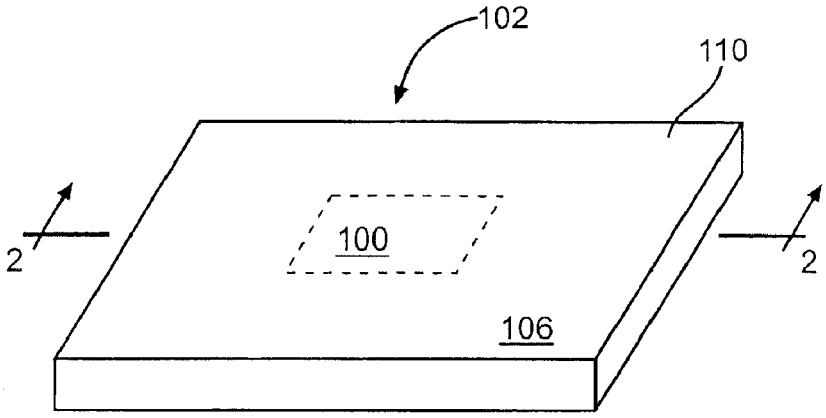
FIG. 1 illustrates an isometric view of the present invention.

The present invention is directed to inserting at least one anti-creep zone 100 into a bladder 102 as shown in FIG. 1. At least one fluid barrier 104 separates the anti-creep zone 100 from the remainder of the bladder 106.

Figure 2:
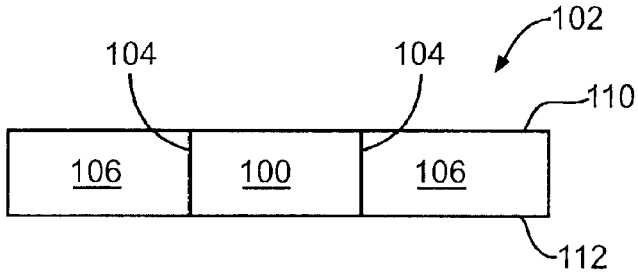
FIG. 2 illustrates a cross-sectional view of FIG. 1 taken along the lines 2—2.
Figure 3:
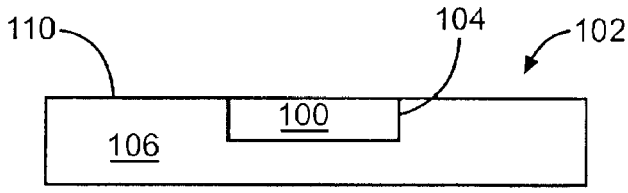
FIGS. 3 and 4 illustrate alternative embodiments of FIG. 2.
Figure 4:
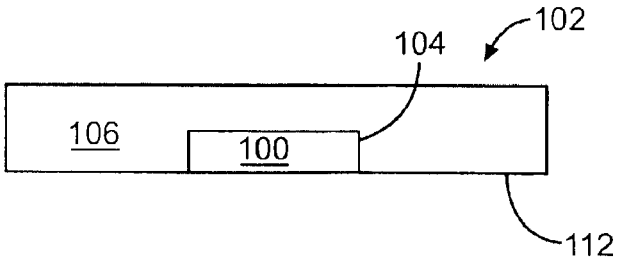

The embodiment illustrated in FIG. 2 clearly illustrates that the fluid barrier 104 extends from the top surface 110 of the bladder 102 that is designed to receive an object thereon, to the bottom surface 112 of the bladder 102. In addition, the fluid barrier 104 can be of the same or different material as the bladder 102 so long as the material separates the fluid in the remainder of the bladder 106 from the fluid within the anti-creep zone 100. As illustrated in FIGS. 3 and 4, the fluid barrier 104 may be interconnected to just the bottom surface 112 (FIG. 4) or the top surface 110 (FIG. 3). The fluid barrier can be attached to the bladder 102 by welding, or any other conventional method to seal a polymeric material to another polymeric material.

Figure 5:
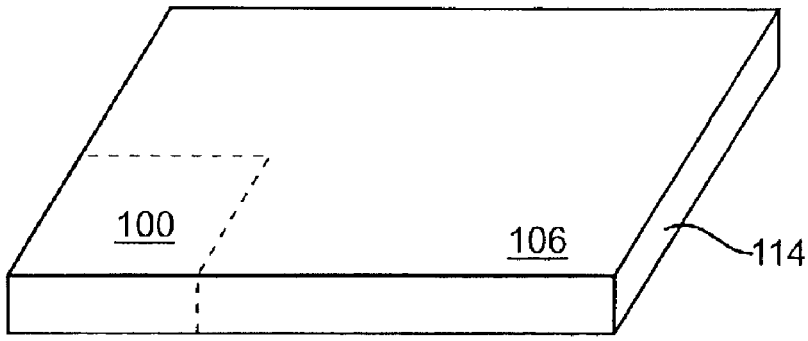
FIGS. 5–7 illustrate alternative embodiments of FIG. 1.
Figure 6:
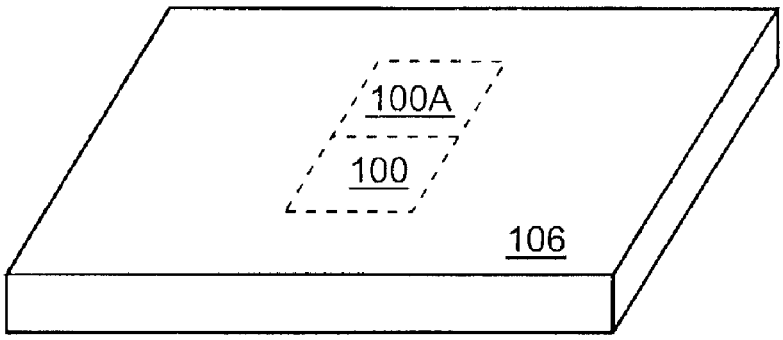
Figure 7:
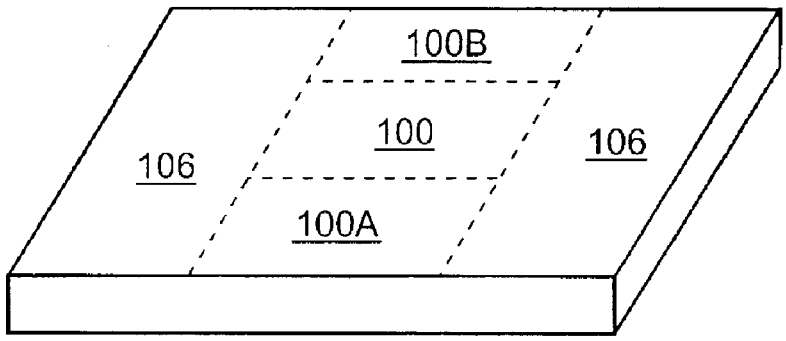

Alternatively, the fluid barrier can be attached to at least one of the sides 114 positioned between the top surface 110 and the bottom surface 112, as illustrated in FIG. 5. In addition, the anti-creep zone 100, or a combination of anti-creep zones 100, 100*a*, 100*b* can be positioned within the bladder 102, as illustrated in FIGS. 6 and 7.

Figure 8:
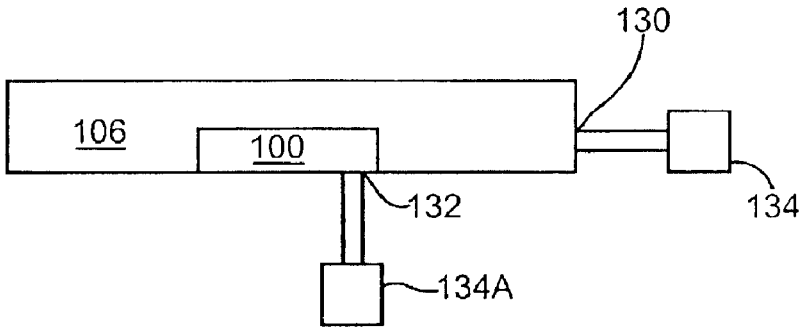
FIGS. 8 and 9 illustrate alternative embodiments for providing a fluid to the anti-creep zone and the remainder of the bladder.
Figure 9:
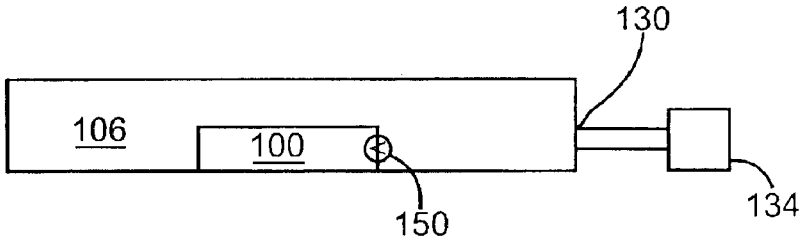

FIGS. 8 and 9 illustrate two embodiments in which fluid is provided to the bladder 102. In each embodiment, a fluid source 134 provides a first fluid into an inlet 130. The first fluid is then within at least the remainder of the bladder 106. That embodiment is illustrated in both FIGS. 8 and 9. The difference between FIGS. 8 and 9 resides in how the anti-creep zone receives its fluid.

As illustrated in FIG. 8, the anti-creep zone 100 can have its own exterior inlet 132 to receive a second fluid from a second fluid source 134*a*. In reality, the fluid sources 134 and 134*a* can be the same or different, and provide the same or distinct fluids.

Alternatively, FIG. 9 illustrates that the anti-creep zone has an inlet valve 150 that allows the first fluid from the remaining bladder 106 to enter the anti-creep zone. In a preferred embodiment, the inlet valve 150 will only allow the first fluid into the anti-creep zone until the first fluid reaches a predetermined pressure within the anti-creep zone.

Once the bladders 102 are filled to a desired pressure, the exterior inlets 130, 132 can be sealed off. That way, the bladders illustrated in FIGS. 8 and 9 can become self-contained bladders.

Alternatively, the bladders illustrated in FIGS. 8 and 9 can become dynamic bladders by retaining the exterior inlet (FIG. 9) or inlets (FIG. 8). A dynamic bladder is one in which the fluid can at least exit the remainder of the bladder 106. FIGS. 10*a–d* illustrates different outlet designs for the anti-creep zone 100. So there is no confusion, the embodiments illustrated in FIGS. 10*a–d* are additional elements that are not illustrated in FIGS. 8 and 9.

Figure 10A:
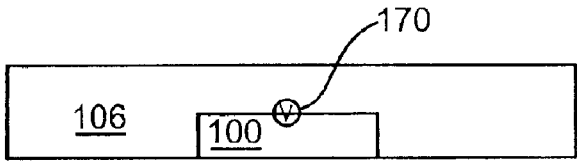
FIGS. 10*a*–*d* illustrates alternative embodiments to expel a fluid from the anti-creep zone.

FIG. 10*a* illustrates an outlet valve 170 that allows the fluid contained in the anti-creep zone 100 to exit into the remainder of the bladder 106. Preferably, the outlet valve 170 will only allow the fluid to exit the anti-creep zone when the fluid within the anti-creep zone exceeds a predetermined pressure. Obviously, the predetermined pressure can be any value determined by the user and/or manufacturer by selecting certain outlet valves 170.

Figure 10B:
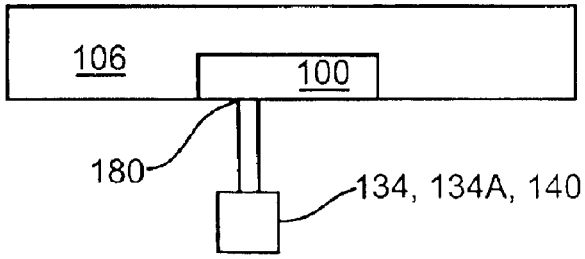

FIG. 10*b* illustrates that the anti-creep zone 100 can alternatively have an exterior outlet 180. The exterior outlet allows the fluid to exit the anti-creep zone into the fluid source 134, 134*a*, or a reservoir 140.

Figure 10C:
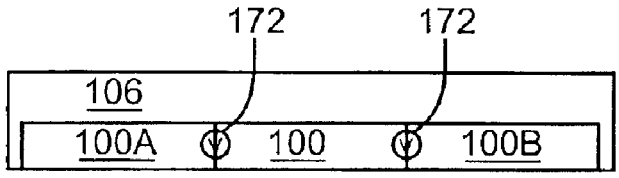

FIG. 10*c* illustrates interconnected anti-creep zones 100, 100*a*, 100*b*. At least one valve 172 interconnects each zone 100, 100*a*, 100*b* to at least another zone, and possibly more. The valve 172 allows a fluid in the anti-creep zones 100, 100*a*, 100*b* to flow between different zones. In one embodiment, the valve 172 will only allow the fluid to flow to another zone if the fluid exceeds a predetermined pressure in the zone the fluid is leaving from.

Figure 10D:
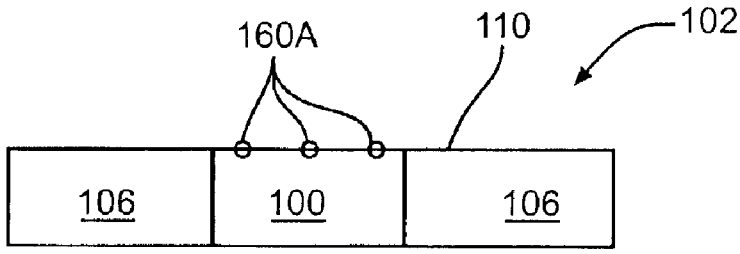

FIG. 10*d* illustrates that the anti-creep zone 100 can have a plurality of apertures 160*a*. If such apertures are utilized, the fluid should exit the anti-creep zone 100 through the top surface 110.

Obviously, the embodiments illustrated in FIGS. 10*a–d* can be incorporated into each anti-creep zone 100. For example, the valves 172 and 170 can be used in a single anti-creep zone 100.

Figure 11:
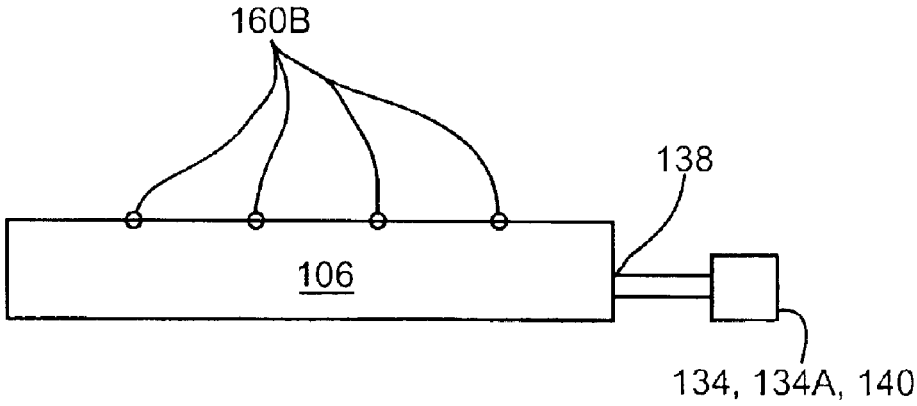
FIG. 11 illustrates embodiments to expel a fluid from the remainder of the bladder.

FIG. 11 illustrates the possible outlet designs for the remainder of the bladder. One possible embodiment is to have an exterior outlet that exhausts the fluid to the fluid sources 134, 134*a*, or reservoir 140. Another embodiment has a plurality of apertures 160*b* positioned on the top surface 110. That way, the fluid can exhaust and apply a fluid to the object positioned on the mattress.

It is desired that the anti-creep zone be positioned in the mattress in a position that receives the greatest weight of the object. For example, if the bladder was being used as a mattress, the anti-creep zone would be positioned preferably under at least the pelvic region of a human being, if the human was the object. In addition, there can be additional anti-creep zones positioned throughout the bladder, and mattress. These anti-creep zones can be individual zones or interconnected zones.

It has been determined that having at least one creep zone positioned in a bladder decreases the chances of the bladder creeping and the object bottoming out on the bladder. The more anti-creep zones used in a bladder and/or the proper positioning of the zones to receive the greatest weight of the object, diminishes the chances of creeping and bottoming out.

Even though they are not illustrated, the bladders illustrated in the figures can have button welds, welds and/or splits therein. These embodiments can be in the remainder of the bladder 106, the anti-creep zone and/or the seal between the fluid barrier 104 and the bladder 102.

The top surface can become the bottom surface by merely flipping the bladder over. Flipping the bladder is standard practice in the industry and does not deviate from the invention.

It should be understood that, while the invention has been described in detail herein, the invention can be embodied otherwise without departing from the principles thereof, and such other embodiments are meant to come within the scope of the present invention as defined by the appended claims.

We claim:

1. An inflatable bladder (a) made of a film material, (b) capable of receiving a first fluid through a first exterior inlet, (c) capable of being used in a mattress system, and (d) having a top surface which is designed to receive an object, a bottom surface that is opposite the top surface and at least one side positioned between the top and the bottom surfaces, comprising:

at least one anti-creep zone defined by an upper surface, a lower surface, and at least one in-between surface positioned between the upper and lower surfaces, having (1) at least a predetermined portion of the at least one in-between surface and (2) the upper surface or the lower surface being fluid barriers that separates the anti-creep zone from the remaining portion of the bladder, capable of containing a second fluid, at least one surface of the anti-creep zone has a valve inlet that allows the second fluid to enter the anti-creep zone when the second fluid exceeds a predetermined pressure, the anti-creep zone is designed not to collapse when a user applies pressure to the bladder and the anti-creep zone to avoid creeping and bottoming out of the bladder, and at least one in-between surface is attached to the bladder surface; and the inflatable bladder has at least one of the following characteristics selected from the group consisting of:

A. the anti-creep zone has a valve outlet for the second fluid that allows the second fluid to exit the anti-creep zone when the fluid exceeds a predetermined pressure;

B. the first and second fluids are two different fluids;

C. the first and second fluid are the same and the valve inlet allows the fluid to enter into the anti-creep zone from the remainder of the bladder;

D. the valve inlet allows the second fluid to enter into the anti-creep zone from a second anti-creep zone; and E. the anti-creep zone has a second exterior inlet.

2. The inflatable bladder of claim 1 wherein the valve outlet allows the second fluid to exit from the anti-creep zone to a second anti-creep zone.

3. The inflatable bladder of claim 1 wherein the valve outlet allows the second fluid to exit from the anti-creep zone to the remainder of the bladder.

4. The inflatable bladder of claim 1 wherein the valve outlet allows the second fluid to exit from the anti-creep zone to an object outside the bladder.

5. The inflatable bladder of claim 1 wherein the anti-creep zone does not contact the at least one side positioned between the top and bottom surfaces of the bladder.

6. The inflatable bladder of claim 1 wherein the anti-creep zone contacts the at least one side positioned between the top and bottom surfaces of the bladder.

7.The inflatable bladder of claim 1 wherein the first exterior inlet is removable after the bladder is inflated to a desired pressure.

8. The inflatable bladder of claim 1 wherein the first and second fluids are the same, except when the characteristic is item B or C.

9. A method of using an inflatable bladder (a) made of a film material, (b) capable of receiving a first fluid through a first exterior inlet, (c) capable of being used in a mattress system, and (d) having a top surface which is designed to receive an object, a bottom surface that is opposite the top surface and at least one side positioned between the top and the bottom surfaces, comprising:

inflating the bladder with a first fluid to a predetermined pressure;

injecting a second fluid into at least one anti-creep zone positioned within the bladder, at least one anti-creep zone defined by an upper surface, a lower surface, and at least one in-between surface positioned between the upper and lower surfaces, having (1) at least a predetermined portion of the at least one in-between surface and (2) the upper surface or the lower surface being fluid barriers that separate the anti-creep zone from the remaining portion of the bladder, capable of containing a second fluid, at least one surface of the anti-creep zone has a valve inlet that allows the second fluid to enter the anti-creep zone when the second fluid exceeds a predetermined pressure, the anti-creep zone is designed not to collapse when a user applies pressure to the bladder and the anti-creep zone to avoid creeping and bottoming out of the bladder, and at least one in-between surface is attached to the bladder surface; and the inflatable bladder has at least one of the following characteristics selected from the group consisting of:

A. the anti-creep zone has a valve outlet for the second fluid that allows the second fluid to exit the anti-creep zone when the fluid exceeds a predetermined pressure;

B. the first and second fluids are two different fluids;

C. the first and second fluid are the same and the valve inlet allows the fluid to enter into the anti-creep zone from the remainder of the bladder;

D. the valve inlet allows the second fluid to enter into the anti-creep zone from a second anti-creep zone; and E. the anti-creep zone has a second exterior inlet.

10. The method of claim 9 wherein the first and second fluids are the same, except when the characteristic is item B or C.

11. The method of claim 9 wherein the fluid barrier does not contact the at least one side positioned between the top surface and the bottom surface.

* * * * *